US006254045B1

(12) United States Patent
Oatsvall

(10) Patent No.: US 6,254,045 B1
(45) Date of Patent: Jul. 3, 2001

(54) EXTENSION LADDER SUPPLY CONTAINER

(76) Inventor: Jon K. Oatsvall, 4681 Highway 64 East, Wartrace, TN (US) 37183

( * ) Notice: Subject to any disclaimer, the term of this patent is extended or adjusted under 35 U.S.C. 154(b) by 0 days.

(21) Appl. No.: 09/525,602

(22) Filed: Mar. 14, 2000

Related U.S. Application Data

(60) Provisional application No. 60/128,298, filed on Apr. 8, 1999.

(51) Int. Cl.[7] ..... E06C 7/14
(52) U.S. Cl. ..... 248/210; 182/129
(58) Field of Search ..... 248/210, 211, 248/238; 182/129

(56) References Cited

U.S. PATENT DOCUMENTS 4,702,446 * 10/1987 Brown ..... 248/210
5,293,957 * 3/1994 Luden, Jr. ..... 182/129
5,960,905 * 10/1999 Gardner ..... 182/129
5,971,103 * 10/1999 Mulvaney ..... 182/129
6,076,636 * 6/2000 Tietge ..... 182/129

* cited by examiner

*Primary Examiner*—Ramon O. Ramirez
(74) *Attorney, Agent, or Firm*—Goldstein Law Offices PC.

(57) ABSTRACT

An extension ladder supply container including a tubular shaft having an inner end and an outer end. The inner end has a movable collar coupled thereto. A basket is provided having an open upper end and a closed lower end. The basket is dimensioned for holding a paint can therein. The basket has a rod extending upwardly therefrom. An upper end of the rod has a collar secured thereto. The collar is rotatably coupled with the tubular shaft inwardly of the outer end thereof. A compressible foam rubber pad is secured to the movable collar of the tubular shaft. The foam rubber pad has a generally semi-cylindrical configuration. The foam rubber pad and the movable collar are receivable within an outer opening in a rung of an extension ladder.

3 Claims, 2 Drawing Sheets

EXTENSION LADDER SUPPLY CONTAINER

CROSS REFERENCES AND RELATED SUBJECT MATTER

This application relates to subject matter contained in provisional patent application Ser. No. 60/128,298, filed in the United States Patent & Trademark Office on Apr. 8, 1999.

BACKGROUND OF THE INVENTION

The present invention relates to an extension ladder supply container and more particularly pertains to coupling with an extension ladder to hold supplies for easy retrieval by a user.

Painting ceilings and high points of walls is often a difficult task, usually requiring the use of a ladder to successfully accomplish. Step ladders are usually used to paint at moderate heights. Extension ladders are required to paint much higher areas. The idea of standing on an extension ladder is a daunting task in itself. Adding a paint brush and a paint can into the hands of the painter makes the task even more dangerous. It is desirable for the painter to have one hand free while the other hand is manipulating the paint brush in order to maintain balance while on the ladder. Some painters have attempted to balance the paint can on a lower rung of the ladder. This often results in the paint can being inadvertently knocked off the ladder or the painter losing his balance while trying to dip the paint brush into the can. A solution to this problem is greatly needed.

The present invention attempts to provide a solution to this problem by providing a device that will secure within an outer opening in a ladder rung and include a basket for holding a can of paint so that the painter has easy access thereto.

The use of ladder accessories is known in the prior art. More specifically, ladder accessories heretofore devised and utilized for the purpose of holding supplies are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,145,226 to LaFontaine discloses a device for holding a paint can and is capable of being mounted to the hollow rung of a ladder. U.S. Pat. No. 4,569,449 to Brent discloses means for attaching a paint can to a ladder, comprised of an elongated post with a pair of clamps incorporated. U.S. Pat. No. 4,013,251 to Cleveland and U.S. Pat. No. 5,511,753 to Lage disclose additional devices for paint can holders used in conjunction with ladders.

While these devices fulfill their respective, particular objective and requirements, the aforementioned patents do not describe an extension ladder supply container for coupling with an extension ladder to hold supplies for easy retrieval by a user.

In this respect, the extension ladder supply container according to the present invention substantially departs from the conventional concepts and designs of the prior art, and in doing so provides an apparatus primarily developed for the purpose of coupling with an extension ladder to hold supplies for easy retrieval by a user.

Therefore, it can be appreciated that there exists a continuing need for new and improved extension ladder supply container which can be used for coupling with an extension ladder to hold supplies for easy retrieval by a user. In this regard, the present invention substantially fulfills this need.

SUMMARY OF THE INVENTION

In the view of the foregoing disadvantages inherent in the known types of ladder accessories now present in the prior art, the present invention provides an improved extension ladder supply container. As such, the general purpose of the present invention, which will be described subsequently in greater detail, is to provide a new and improved extension ladder supply container and method which has all the advantages of the prior art and none of the disadvantages.

To attain this, the present invention essentially comprises a tubular shaft having an inner end and an outer end. The tubular shaft has an interior rotating shaft disposed interiorly thereof extending from the inner end to the outer end. The inner end has a movable collar coupled thereto. The movable collar is secured to the interior rotating shaft. The outer end has a rotating handle extending inwardly thereof. The rotating handle is secured to an opposite end of the interior rotating shaft whereby turning of the rotating handle will slide the movable collar with respect to the tubular shaft. A cylindrical basket is provided having an open upper end and a closed lower end. The cylindrical basket is dimensioned for holding a paint can therein. The basket has a rod extending upwardly therefrom. An upper end of the rod has a collar secured thereto. The collar is rotatably coupled with the tubular shaft inwardly of the outer end thereof. A compressible foam rubber pad is secured to the movable collar of the tubular shaft. The foam rubber pad has a generally semi-cylindrical configuration. The foam rubber pad and the movable collar are receivable within an outer opening in a rung of an extension ladder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved extension ladder supply container which has all the advantages of the prior art ladder accessories and none of the disadvantages.

It is another object of the present invention to provide a new and improved extension ladder supply container which may be easily and efficiently manufactured and marketed.

It is a further object of the present invention to provide a new and improved extension ladder supply container which is of durable and reliable construction.

An even further object of the present invention is to provide a new and improved extension ladder supply container which is susceptible of a low cost of manufacture with regard to both materials and labor, and which accordingly is then susceptible of low prices of sale to the consuming public, thereby making such an extension ladder supply container economically available to the buying public.

Even still another object of the present invention is to provide a new and improved extension ladder supply container for coupling with an extension ladder to hold supplies for easy retrieval by a user.

Lastly, it is an object of the present invention to provide a new and improved extension ladder supply container including a tubular shaft having an inner end and an outer end. The inner end has a movable collar coupled thereto. A basket is provided having an open upper end and a closed lower end. The basket is dimensioned for holding a paint can therein. The basket has a rod extending upwardly therefrom. An upper end of the rod has a collar secured thereto. The collar is rotatably coupled with the tubular shaft inwardly of the outer end thereof. A compressible foam rubber pad is secured to the movable collar of the tubular shaft. The foam rubber pad has a generally semi-cylindrical configuration. The foam rubber pad and the movable collar are receivable within an outer opening in a rung of an extension ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
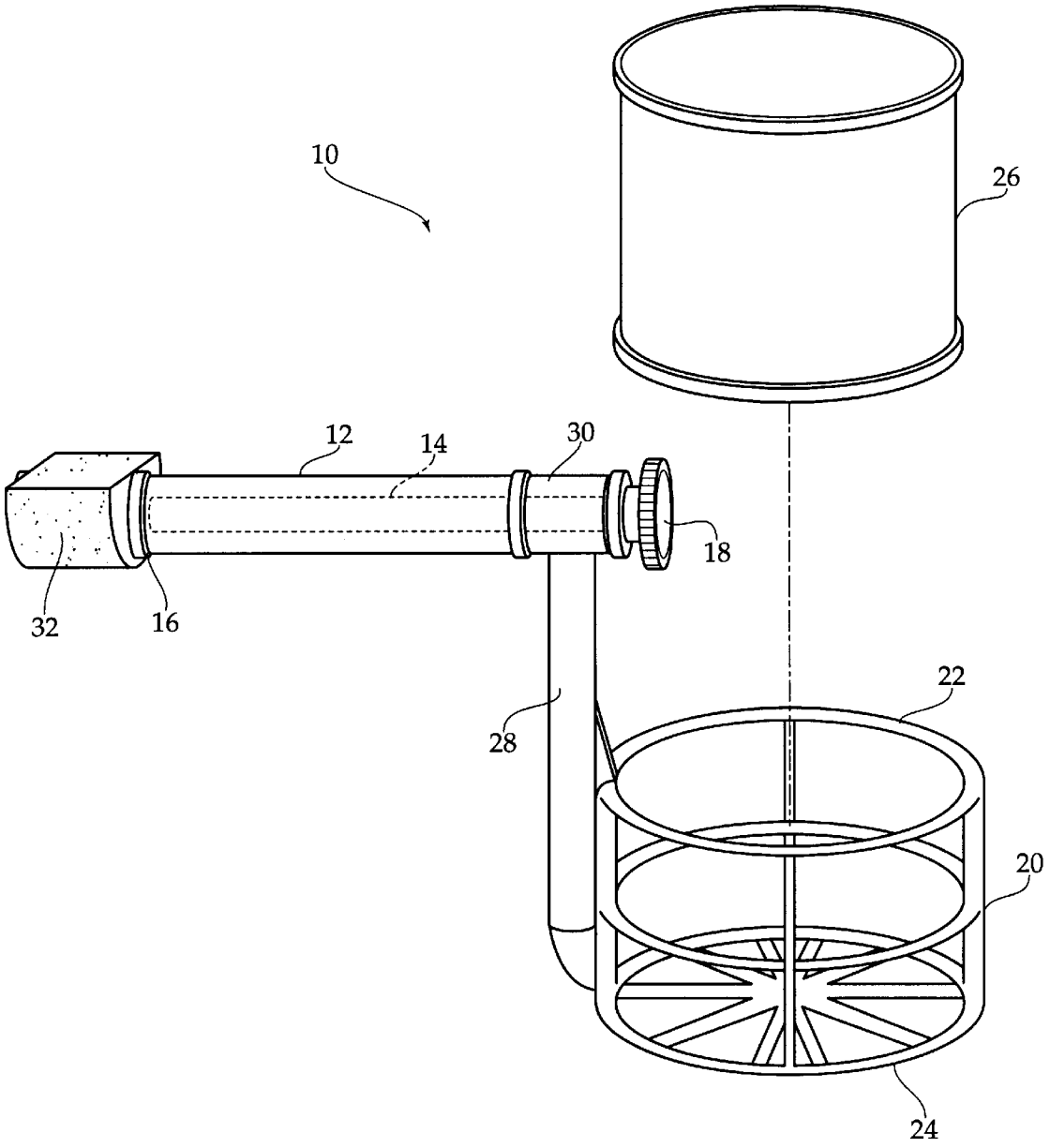
FIG. 1 is a perspective view of the preferred embodiment of the extension ladder supply container constructed in accordance with the principles of the present invention.
Figure 2:
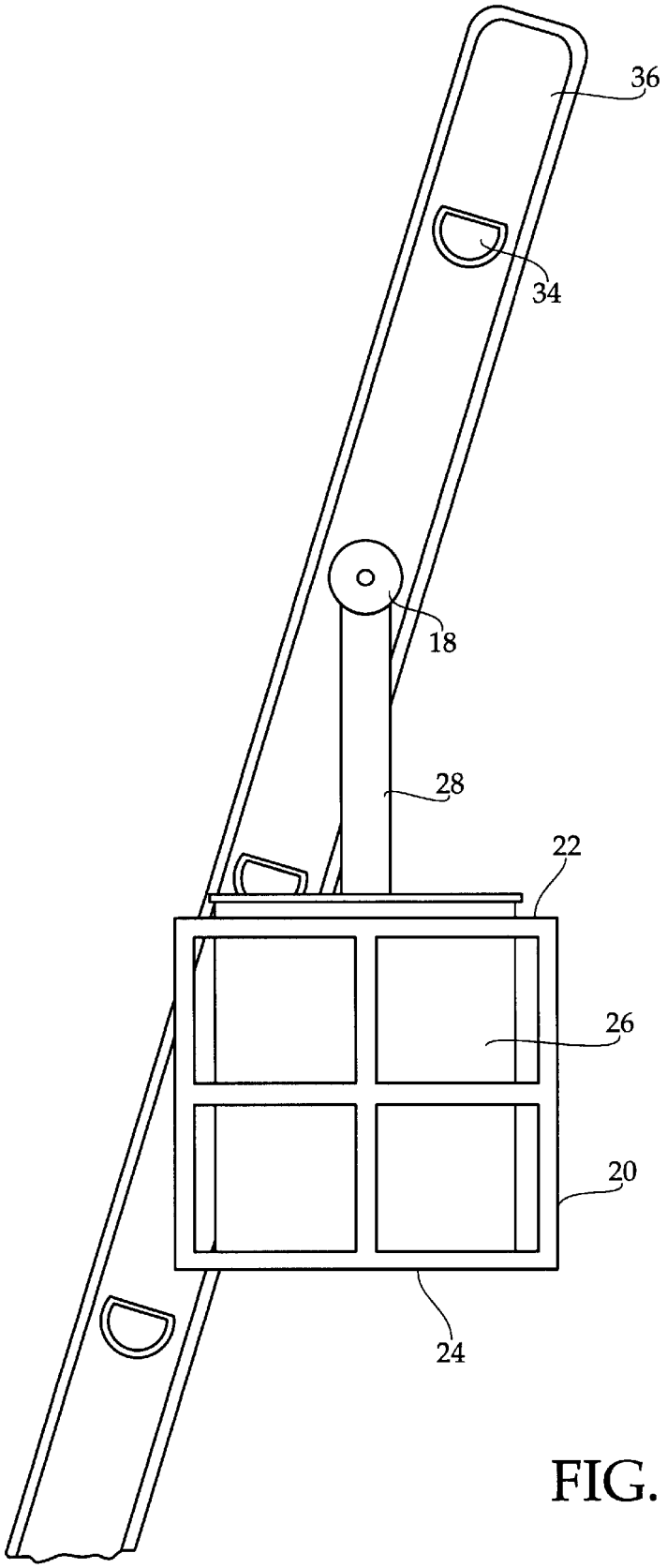
FIG. 2 is a side elevation view of the present invention illustrated secured to an extension ladder.

With reference now to the drawings, and in particular, to FIGS. 1 through 2 thereof, the preferred embodiment of the new and improved extension ladder supply container embodying the principles and concepts of the present invention and generally designated by the reference number 10 will be described.

Specifically, it will be noted in the various Figures that the device relates to a extension ladder supply container for coupling with an extension ladder to hold supplies for easy retrieval by a user. In its broadest context, the device consists of a tubular shaft, a cylindrical basket, and a compressible foam rubber pad. Such components are individually configured and correlated with respect to each other so as to attain the desired objective.

The tubular shaft 12 has an inner end and an outer end. The tubular shaft 12 has an interior rotating shaft 14 disposed interiorly thereof extending from the inner end to the outer end. The inner end has a movable collar 16 coupled thereto. The movable collar 16 is secured to the interior rotating shaft 14. The outer end has a rotating handle 18 extending inwardly thereof. The rotating handle 18 is secured to an opposite end of the interior rotating shaft 14 whereby turning of the rotating handle 18 will slide the movable collar 16 with respect to the tubular shaft 12.

The cylindrical basket 20 has an open upper end 22 and a closed lower end 24. The cylindrical basket 20 is dimensioned for holding a paint can 26 therein. The basket 20 has a rod 28 extending upwardly therefrom. An upper end of the rod 28 has a collar 30 secured thereto. The collar 30 is rotatably coupled with the tubular shaft 12 inwardly of the outer end thereof.

The compressible foam rubber pad 32 is secured to the movable collar 16 of the tubular shaft 12. The foam rubber pad 32 has a generally semi-cylindrical configuration. The foam rubber pad 32 and the movable collar 16 are receivable within an outer opening 34 in a rung of an extension ladder 36. Note FIG. 2.

In use, the inner end of the tubular shaft 12 is inserted into the outer opening 34 of the extension ladder 36 whereby the compressible foam rubber pad 32 and the movable collar 16 are positioned interiorly of the outer opening 34. The rotating handle 18 is then turned thereby causing the movable collar 16 to slide outwardly causing the foam rubber pad 32 to expand within the outer opening 34 creating a tight securement. The paint can 26 or other tools can then be placed within the basket 20 so as to be in easy reach of a person using the ladder 36.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An extension ladder supply container for coupling with an extension ladder to hold supplies for easy retrieval by a user comprising, in combination:

a tubular shaft having an inner end and an outer end, the tubular shaft having an interior rotating shaft disposed interiorly thereof extending from the inner end to the outer end, the inner end having a movable collar coupled thereto, the movable collar being secured to the interior rotating shaft, the outer end having a rotating handle extending inwardly thereof, the rotating handle being secured to an opposite end of the interior rotating shaft whereby turning of the rotating handle will slide the movable collar with respect to the tubular shaft;

a cylindrical basket having an open upper end and a closed lower end, the cylindrical basket being dimensioned for holding a paint can therein, the basket having a rod extending upwardly therefrom, an upper end of the rod having a collar secured thereto, the collar being rotatably coupled with the tubular shaft inwardly of the outer end thereof;

a compressible foam rubber pad secured to the movable collar of the tubular shaft, the foam rubber pad having a generally semi-cylindrical configuration, the foam rubber pad and the movable collar being receivable within an outer opening in a rung of an extension ladder.

2. An extension ladder supply container for coupling with an extension ladder to hold supplies for easy retrieval by a user comprising, in combination:

a tubular shaft having an inner end and an outer end, the inner end having a movable collar coupled thereto;

a basket having an open upper end and a closed lower end, the basket having a rod extending upwardly therefrom, an upper end of the rod having a collar secured thereto, the collar being rotatably coupled with the tubular shaft inwardly of the outer end thereof;

a compressible foam rubber pad secured to the movable collar of the tubular shaft, the foam rubber pad having a generally semi-cylindrical configuration, the foam rubber pad and the movable collar being receivable within an outer opening in a rung of an extension ladder.

3. The extension ladder supply container as set forth in claim 2 wherein the tubular shaft has an interior rotating shaft disposed interiorly thereof extending from the inner end to the outer end, the movable collar being secured to the interior rotating shaft, the outer end having a rotating handle extending inwardly thereof, the rotating handle being secured to an opposite end of the interior rotating shaft whereby turning of the rotating handle will slide the movable collar with respect to the tubular shaft.

* * * * *